United States Patent [19]

Molitor

[11] 4,204,684

[45] May 27, 1980

[54] GOLF CLUB HEAD AND METHOD OF PRODUCING SAME

[75] Inventor: Robert P. Molitor, South Hadley, Mass.

[73] Assignee: Questor Corporation, Toledo, Ohio

[21] Appl. No.: 846,849

[22] Filed: Oct. 31, 1977

[51] Int. Cl.[2] ..... A63B 53/04

[52] U.S. Cl. ..... 273/167 R

[58] Field of Search ..... 273/67 R, 67 A, 72 R, 273/73 R, 73 C, 73 F, 82 R, 167 R, 167 F, DIGS. 1-12, 169; 280/610

[56] References Cited

U.S. PATENT DOCUMENTS

| | | | |
|---|---|---|---|
| 556,042 | 3/1896 | Briggs | 273/167 R X |
| 1,567,323 | 12/1925 | Jordan | 273/77 R |
| 2,880,002 | 3/1959 | Wetty | 273/167 R X |
| 3,390,881 | 7/1968 | Senne | 273/167 R X |
| 3,397,889 | 8/1968 | Smith | 273/82 R |
| 3,455,558 | 7/1969 | Onions | 273/169 |
| 3,591,183 | 7/1971 | Ford | 273/167 R |
| 3,635,483 | 1/1972 | Barriball et al. | 273/73 F X |
| 4,052,499 | 10/1977 | Goupil et al. | 273/67 A X |
| 4,070,019 | 1/1978 | Segal et al. | 273/73 F |

*Primary Examiner*—Richard J. Apley

*Attorney, Agent, or Firm*—Harry O. Ernsberger

[57] ABSTRACT

The disclosure embraces a golf club head and method of producing same wherein the head is fashioned of laminations or layers of resinous or plastic materials bonded together to form an integrated or composite head or body wherein certain laminations or layers have particular characteristics and other laminations or layers have different characteristics, the laminations or layers having particular characteristics being preferably alternately oriented in assembly with the laminations or layers having different characteristics providing a golf club head which is dimensionally stable and of high durability and structural integrity and having high impact resistance at relatively the same density as a solid persimmon wood head.

12 Claims, 6 Drawing Figures

GOLF CLUB HEAD AND METHOD OF PRODUCING SAME

This invention relates to a golf club and more particularly to a golf club head fashioned of resinous or plastic materials and to a method and process of producing same.

Heretofore the so-called "wood" clubs have been fashioned with heads made of wood. The heads of such clubs may be of a solid piece of wood or fashioned of wood laminae stacked one upon another and adhesively joined into a unitary body with or without an insert in the striking face of the club head. Wood heads for golf clubs are usually made of a block of persimmon or are built up of layers or laminations of maple glued together or a solid block of acrylonitrile-butadiene-styrene or other resinous material.

In processing heads of wood, extensive sanding is required and the final finish is usually the application of an overlay or coating of paint or varnish. If the overlay becomes scratched, a bare wood surface is exposed which is usually in contrast with the final finish. Because of the fibrous nature of the wood, either persimmon or laminations of maple, the wood heads, when subjected to climatic atmospheric conditions, shrink or swell depending upon temperature and moisture and hence are not dimensionally stable.

The present invention resides in a golf club head simulating a golf club head of wood but fashioned of laminations, layers or laminae of resinous material which are joined to form an integrated or composite head wherein certain laminations or layers have particular characteristics and other layers have different characteristics, providing a golf club head having high impact resistance and which is dimensionally stable, of high durability and structural integrity.

An object of the invention resides in a golf club head fashioned of a plurality of layers or laminations of resinous or plastic material wherein certain laminations are solid or noncellular and other layers or laminations are of foamed or unicellular character, the solid or noncellular laminations being preferably alternately oriented in assembly with the foamed or unicellular laminations, the layers or laminations being bonded together providing a head having high impact resistance.

Another object of the invention resides in a golf club head fashioned of a plurality of layers or laminations of resinous or plastic material wherein certain laminations are solid or noncellular and other layers or laminations are of foamed or unicellular character providing a golf club head requiring a minimum of processing operations as the resinous or plastic material provides a high luster finish without an overlay or coating of paint or varnish.

Another object of the invention is the provision of a golf club head fashioned of layers or laminations of resinous or plastic material joined into an integral unit or body wherein the layers or laminations may be of different colors so as to provide a distinctive and aesthetic appearance which is not impaired by scratching or scuffing of the surface.

Another object of the invention is the provision of a golf club head fashioned of layers or laminations of resinous material bonded together to provide structural integrity and which may be shaped or contoured to facilitate various arrangements of shaft positioning whereby the shaft may be in a direct line with the impact face of project in front of or rearwardly of the face and that the angularity of the face of the club head may be varied without impairing the structural integrity of the head.

Another object of the invention resides in a golf club head fashioned of layers or laminations of resinous or plastic materials wherein at least one group of laminations are of unicellular or foamed character providing an initial lightweight head which facilitates weighting the head with various inserts or weights to attain a desired weighting system of a character whereby the center of the mass of the weighting system may be directly positioned in line with the central impact region of the face. Another object of the invention resides in the provision of a golf club head fashioned of layers or laminations of resinous or plastic material bonded together, the head of this construction being highly resistant to damage by impact, abrasion or contact with small stones or debris and rendering unnecessary the use of a sole plate or an insert or face piece in the impact face of the head.

Another object of the invention is the provision of a golf club head fashioned of laminations of unicellular or foamed resin and laminations or noncellular or solid resin wherein the weight of the laminated head may be governed in a measure by varying the density of the foamed resin laminations and further varied by modifying the respective quantities of the foamed and solid resin of the laminations in the head structure.

The invention embraces a method or process of producing a composite golf club head comprising assembling foamed and unfoamed layers, laminations or laminae of resinous or plastic material and bonding the layers, laminations or laminae into an integral or composite body and fashioning the body into a desired shape or configuration of golf club head and orienting one or more weights or inserts in the head structure to attain a desired weight system without affecting the structural integrity of the composite head.

Another object of the invention resides in a golf club head comprising a composite body of layers of resinous material which body may be produced at low cost and providing a head having a high degree of uniformity and stability.

Further objects and advantages are within the scope of this invention such as relate to the arrangement, method of operation and function of the related elements, to various details of construction and to combinations of parts, elements per se, and to economies of manufacture and numerous other features as will be apparent from a consideration of the specification and drawing of a form of the invention, which may be preferred, in which.

Figure 2:
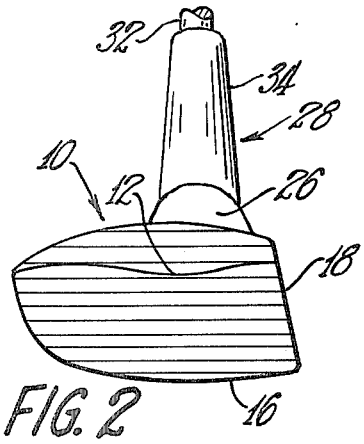
FIG. 2 is a front elevational view of the club head shown in FIG. 1.
Figure 1:
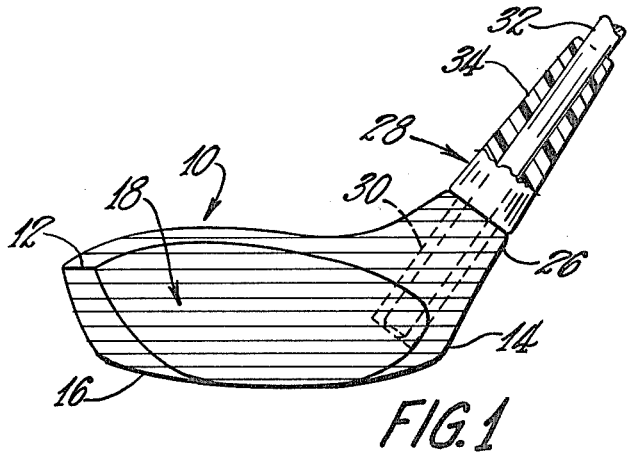
FIG. 1 is a side elevational view of a club head and a portion of the shaft attaching means.
Figure 3:
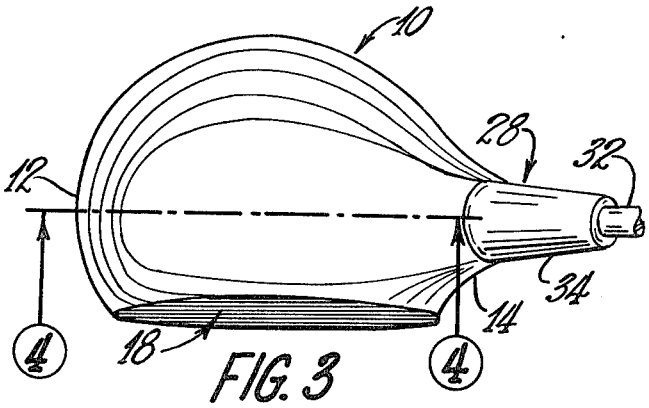
FIG. 3 is a top plan view of the club head.

Referring to the drawings, FIGS. 1, 2 and 3 illustrate a golf club head of the invention simulating the form of a conventional wood golf club head. The golf club head 10 is shaped or configurated with a toe end region 12, a rearward or heel portion 14, a sole surface 16 extending generally longitudinally between the toe and heel portions, and a longitudinally extending impact surface or face 18.

The face or impact surface 18 is angularly disposed with respect to the generally horizontal sole surface 16 and is differently angled in different clubs to provide a desired loft for the impact surface 18, such as a maximum loft, minimum loft or any intermediate loft as is conventional in club heads fashioned of wood.

In the golf club head of the invention, the head 10 is a composite body composed of a substantial number of layers, laminations or laminae of resinous or plastic material arranged in stacked relation, certain layers or laminae 22 being of a resin having particular characteristics and other layers or laminations 24 having different characteristics as hereinafter further described.

The golf head 10 is fashioned with a shank or neck portion 26. An adaptor or member 28 preferably fashioned of resin is provided for securing the shaft 32 to the club head. The neck or shank portion 26 of the head 10 is provided with a bore which snugly accommodates a sleeve portion 30 of member 28. The member 28 including its sleeve portion 30 is bored to accommodate a conventional shaft 32 which may be of metal or other suitable material.

The upper portion 34 of member 28 is of frusto-conical shape, the lower end of portion 34 abutting the shank or neck portion 26 as shown in FIG. 1. The sleeve portion 30 is bonded to the club head and to the shaft by a suitable bonding resin in a conventional manner. It is to be understood that other suitable means may be employed for joining the shaft 32 to the club head 10.

Figure 4:
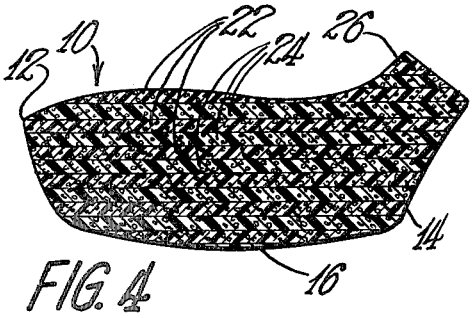
FIG. 4 is a sectional view of the head, the view being taken substantially on the line 4—4 of FIG. 3.

The layers, laminations or laminae may be fashioned of the same or similar resin or plastic wherein certain layers, laminations or laminae are of a solid or noncellular character, and other layers, laminations or laminae of expanded, foamed or unicellular character. In the embodiment illustrated in the drawings the club head 10 is constructed of layers or laminae 22 of solid or noncellular resin and the alternate layers 24 of foamed or cellular resin. The layers or laminations 22 and 24 are preferably alternately arranged as shown in FIG. 4.

A resin that has been found satisfactory for the purpose is acrylonitrile-butadiene-styrene, usually referred to as ABS. The layers or laminae 22 and 24 are preferably horizontally oriented lengthwise of the club head as indicated in FIG. 4. The layers or laminae 22 and 24 are preferably bonded together by an adhesive solution of the same resin to form a composite or unitary body.

The impact or striking face 18 of the head 10 comprises the edges of the alternate resin layers 22 and 24. The orientation of the layers of resin provides a striking surface of high impact resistance which is found to be several times the impact resistance of a laminated maple head structure. In golf club heads fashioned of wood it is usual to provide a face plate or insert on the striking or impact face of the head of solid acrylonitrile-butadiene-styrene.

It is found that the head structure of the invention fashioned of unicellular and noncellular layers or laminae of resin such as acrylonitrile-butadiene-styrene is endowed with sufficient impact resistance that a face plate or insert is not required. However, the laminated head construction may be provided with an impact face plate or insert and the laminations contoured to accommodate the same.

A sole plate may, if desired, be provided on the laminated head construction of the invention on the fairway woods as further protection against abrasion by small stones. In constructing the laminated or composite golf club head of the invention, extruded sheets of acrylonitrile-butadiene-styrene resin are employed as such resin sheets do not have any appreciable residual or incipient stresses so that the laminations of such resin oriented into a golf club head provide dimensional stability and are not affected by climatic atmospheric conditions such as temperature and moisture.

As the composite club head of the invention does not require an impact face insert or a sole plate, the construction facilitates the use of a variety of weighting systems for varying the swing weight and total weight of the golf club. The laminated head construction of resin embodying foamed or unicellular laminates is of lighter weight or less mass than a corresponding head fashioned of persimmon or laminated maple. Hence, a weighting system may be employed which allows the placing of additional weight behind the ball impact point so that the weighting mass may be of greater magnitude than with conventional heads made of wood.

Figure 5:
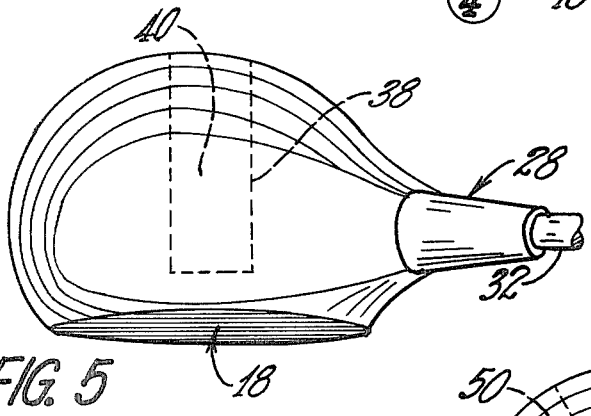
FIG. 5 is a top plan view similar to FIG. 3 illustrating one form of weighting system for the club head.
Figure 6:
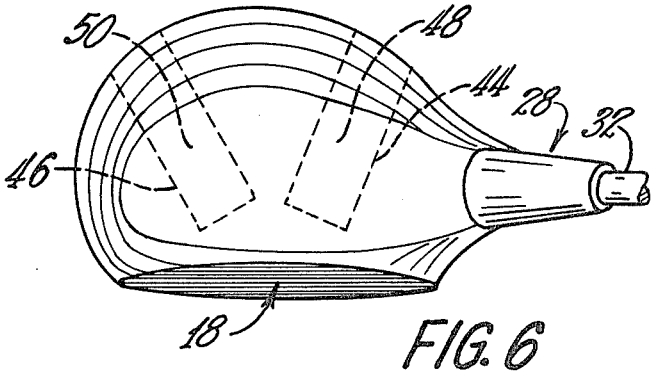
FIG. 6 is a plan view similar to FIG. 5 illustrating another form of weighting system for the club head.

FIGS. 5 and 6 illustrate two forms of weighting system that may be utilized with the golf club of the invention. In FIG. 5, the head is bored from the rear surface toward the impact surface on an axis in line with the ball impact point approximately at the center of the impact face 18. As shown in FIG. 5, the head is provided with a bore 38 entering at the rear surface of the club head.

A weight or insert member 40 of metal, dense resin or other material, is snugly inserted in the bore and, if desired, cemented or bonded to the club head. As the club head is fashioned of resin and is of lighter weight than a corresponding head made of wood, a variety of different weights 40 may be used to impart the desired swing weight and total weight characteristics to the club head.

FIG. 6 illustrates another form of weighting system for the club head of the invention. In this form two bores 44 and 46 are provided opening at the rear face of the head, the axis of the bores being angularly arranged as shown in FIG. 6. The bores are respectively provided with weights or masses 48 and 50 which may be of metal, dense resin or other suitable material. The weighting arrangement of FIG. 6 is advantageous where it is desired to increase the weighting of the head without impairing the strength of the laminated head. In the arrangement shown in FIG. 6, the effective axis or moment of the sum of the weights 48 and 50 is on a center of the impact face or surface 18.

In reference to the weighting system for the head, certain of the laminations may be precut providing open areas of contours which, upon assembly of the laminations, provide a recess or recesses to receive and accommodate an insert or inserts of the weighting system.

In fashioning the club head of the invention extruded sheets of the acrylonitrile-butadiene-styrene resin are employed, one group of resin sheets being of solid or dense, noncellular character and the other group of resin sheets being of expanded, foamed or unicellular character. The layers or laminations are preferably precut from the sheets and each layer or lamination is cut to the proper contour depending upon its position in the stack of layers or laminations. The laminations or sheets are coated on each major surface with a solution of acrylonitrile-butadiene-styrene resin or other suitable adhesive or bonding resin. In the embodiment shown in FIG. 4, the solid or dense laminations 22 and the expanded or foamed laminations 24 are alternated in the assembly.

The stack of laminations are placed in a press to cause the laminations to be pressed into contiguous relation. The stack or block of laminations is then dried to set the resin between successive laminations of the stack or block. The composite resin body or block is turned or formed in a conventional manner to the head configuration desired. An opening or openings are formed in the head or certain laminations precut with open areas to accommodate the weights of the weighting system such as shown in FIGS. 5 and 6, and the shaft 32 assembled with the head by means of the adaptor or member 28. The head is then lightly sanded and polished on a cloth polishing wheel to attain a high luster. Through this method there is no need for an overlay of paint or varnish because the polished resin provides a fine finish.

The laminations or laminae 22 and 24 are preferably alternately oriented as shown in FIG. 4 but, if desired, may be oriented in a different form. The laminations may be of different thicknesses. For example, the thickness of each of the laminations or laminae may be in a range from about twenty thousandths of an inch to one hundred twenty-five thousandths of an inch or more. As shown in FIG. 4, the laminations are of about the same thickness and are generally parallel with the sole or lower surface 16 but it is to be understood that the laminations of unicellular resin may be of different thicknesses than the laminations of noncellular resin, and that the laminations may be oriented at various angles with respect to the generally horizontal sole surface 16.

The laminations 22 and 24 may be of different colored resins or plastics to enhance the aesthetic appearance of the club head. Through the utilization of layers of foamed or unicellular resin, a comparatively lightweight head may be constructed so as to effect an increased range of adaptability for the weighting system, that is, the head weight may be varied over a substantial range simply by varying the weight or mass of the inserts such as the insert shown at 40 in FIG. 5 or the inserts 48 and 50 shown in FIG. 6.

The laminated or composite club head retains its stability under all atmospheric conditions and does not absorb moisture. If the surface of the head becomes scratched or scuffed, a polishing operation is usually all that is required to restore its original luster and finish.

By selecting a particular amount of foam resin and foam of a desired density, the vibration damping and/or energy transmitting properties of the head can be accurately controlled. The resultant physical properties of a head of laminated resinous material provides greater impact resistance than either a persimmon wood head or a laminated maple wood head.

While it has been found preferable to use as an adhesive a solution of acrylonitrile-butadiene-styrene resin for bonding the laminations into a unitary or composite body, it is to be understood that other bonding resins or other suitable adhesives may be employed.

If desired, carbon fibers, glass fibers, nylon fibers or other reinforcing materials can be embodied in the resin laminations or laminae to vary the physical properties of the club head.

A desirable decorative effect can be obtained through the use of resinous layers or laminations which have been pigmented with flaky pigments such as pearl essence (natural or synthetic) or metallic flake pigments. In processing the resinous sheet of which the laminations are formed, the flake pigments become generally oriented parallel to the surface. When such pigmented laminations are oriented to form the golf club head, the contouring operation in shaping the head reveals the pigmented laminations in a reflective three-dimensional effect which presents a pleasing appearance.

The laminated club head of the invention may be fashioned of an assemblage of laminates or laminae of an ionomer, a resin marketed under the name Surlyn, and polyamide resin (Nylon). In fabricating a laminated head of these resins either the ionomer resin or the polyamide resin may be foamed or unicellular and the other used as a solid. The weight and physical characteristics of the head fashioned of these resins may be varied by varying the density of the foamed resin as well as by varying the thicknesses of the laminations or laminae comprising the head construction. The head may be provided with a weighting system of the character illustrated in FIGS. 5 and 6.

In the process of producing a laminated head structure of ionomer and polyamide resins, high frequency or dielectric heating may be employed to effect bonding of these resinous materials.

It is apparent that, within the scope of the invention, modifications and different arrangements may be made other than as herein disclosed, and the present disclosure is illustrative merely, the invention comprehending all variations thereof.

I claim:

1. A golf head comprising a laminated body wherein the laminations are solely of resinous materials, said body comprising a plurality of stacked laminations of resinous materials, the resin of certain of the laminations being unicellular and the resin of the remaining laminations being noncellular, said laminations being bonded together in the body.

2. A golf club head comprising a composite body of stacked laminations wherein the laminations are solely of resinous materials, certain of the laminations being of noncellular resin and the remaining laminations of unicellular resin, said laminations being bonded together in the body to provide the golf club head, said head having an impact face comprising exposed edges of the laminations.

3. A golf club head according to claim 2 wherein the noncellular resin laminations are in alternate arrangement with the unicellular resin laminations.

4. A golf club head comprising a laminated body wherein the laminations are solely of resinous materials, the body having a forward end, a rearward end and a longitudinally extending sole surface, the laminated body comprising laminations of noncellular resin in alternate arrangement with laminations of foamed resin, said laminations being in stacked relation and bonded together into a unitary body, the head having an impact face comprising the exposed edges of the laminations.

5. A golf club head according to claim 4 wherein both noncellular resin laminations and the laminations of foamed resin are of acrylonitrile-butadiene-styrene.

6. A golf club head according to claim 4 wherein the noncellular resin laminations and the foamed resin laminations are bonded together by coatings of acrylonitrile-butadiene-styrene resin.

7. A golf club head comprising a laminated body wherein the laminations are solely of resinous materials, the body having a forward end, a rearward end and a longitudinally extending sole surface, the laminated body comprising stacked laminations of noncellular resin in alternate arrangement with laminations of unicellular resin, said laminations being of a thickness in a range of about twenty thousandths of an inch to about one hundred twenty five thousandths of an inch, said laminations being bonded together into a unitary body, the head having an impact face comprising the exposed edges of the laminations.

8. A golf club head comprising a laminated body wherein the laminations are solely of resinous materials, the body having a forward end, a rearward end and a longitudinally extending sole surface, the laminated body comprising stacked laminations of noncellular resin and of unicellular resin, one group of the laminations being of an ionomer resin, the other group of the laminations being of polyamide resin, said laminations being bonded together into a unitary body, said head having an impact surface comprising the exposed edges of the laminations.

9. A golf club head according to claim 8 wherein the laminations of an ionomer resin are in alternate arrangement with the laminations of polyamide resin.

10. A golf club head according to claim 8 wherein the ionomer resin laminations are of noncellular resin and the laminations of polyamide resin are of unicellular resin.

11. A golf club head according to claim 8 wherein the ionomer resin laminations are of unicellular resin and the laminations of polyamide resin are nonceullular.

12. A golf club head comprising a laminated body wherein the laminations are solely of resinous materials, the body having a forward end, a rearward end and a longitudinally extending sole surface, the laminated body comprising laminations of noncellular resin in alternating arrangement with laminations of foamed resin, said laminations being in stacked relation and bonded into a unitary body, the noncellular resin being of one color, and the foamed resin being of a different color, the head having an impact face comprising the exposed edges of the laminations.

* * * * *